United States Patent [19]

Aranda

[11] Patent Number: 4,932,914

[45] Date of Patent: Jun. 12, 1990

[54] CADENCE CALLER

[76] Inventor: George L. Aranda, 212 NE. 176th Ave., Portland, Oreg. 97230

[21] Appl. No.: 354,356

[22] Filed: May 19, 1989

[51] Int. Cl.[5] ..... A63H 5/00

[52] U.S. Cl. ..... 446/26; 446/419; 36/139

[58] Field of Search ..... 446/26–28, 446/418, 419, 421; 36/139; 273/DIG. 18

[56] References Cited

U.S. PATENT DOCUMENTS

| | | | |
|---|---|---|---|
| 1,567,803 | 12/1925 | Ludwig | 446/421 |
| 2,291,791 | 8/1942 | Casserd | 36/139 X |
| 2,472,408 | 6/1949 | Angelo | 446/421 |
| 2,811,811 | 11/1957 | Faranda | 446/26 |

*Primary Examiner*—Mickey Yu

*Attorney, Agent, or Firm*—Olson & Olson

[57] ABSTRACT

A cadence caller is formed of a U-shaped clip member arranged for releasable attachment to a conventional shoe, the clip member mounting on its upper wall surface a vertically extending, longitudinally elongated post which receives a pair of cymbals through a centrally located bore provided through each, the bore being of greater diameter than the diameter of the post so that the cymbals are permitted free sliding movement along the post. An enlarged end cap, greater in diameter than the bores through the cymbals, is provided on the terminal end of the post to retain the cymbals on the post as they move in response to the movement of the shoe during walking and jogging. The resulting sound of the cymbals contacting each other gives an audible indication of each step.

4 Claims, 1 Drawing Sheet

CADENCE CALLER

BACKGROUND OF THE INVENTION

This invention relates to noise makers and cadence callers that are attachable to shoes for the purpose of creating an audible sound at each step in walking or jogging. More particularly, this invention relates to a greatly simplified construction of a cadence caller for economical manufacture and reliability of use.

Noise makers that are activated by a person's stride during walking and jogging are known in the art, and illustrative of this art are U.S. Pat. Nos. 2,811,811; 4,312,567; 3,878,641; 2,291,791; and 4,278,248. The first three of the patents identified above are most closely related to the present invention. U.S. Pat. No. 2,811,811 is believed to illustrate the closest prior art.

The object of these devices is to create a sound which marks a step, either for novelty or, as in jogging, to assist in maintaining a regular step or pace by recognizing that pace audibly. Most of the constructions heretofore available in the art however are structurally rather complex, even extending to elaborate, complete shoe constructions configured to accomplish the rather simple result. Such devices, while often times unjustifiably expensive for noise making, also involve structures which are easily breakable, particularly considering the magnitude and duration of the shock that they are subjected to in walking and jogging activities.

SUMMARY OF THE INVENTION

In its basic concept, this invention provides a cadence caller which freely mounts a pair of cymbals on a vertically extending post that projects from an attachment to a shoe, so that each movement of the shoe effects a movement of the cymbals on the post and results in an audible sound.

It is by virtue of the foregoing basic concept that the principal objective of this invention is achieved; namely, the provision of a cadence caller which is of simplified construction for economical manufacture and for durability in use.

Another object of this invention is the provision of a cadence caller of the class described which may be mounted to a shoe removably, and may be attached to any type of shoe or other wearing apparel as desired.

Another object of this invention is the provision of a cadence caller of the class described in which the caller may be provided in a variety of intentionally different pitches or sounds by simple substitution of one or more of the cymbals with others of different size or material either during manufacture or subsequent thereto.

The foregoing and other objects and advantages of this invention will appear from the following detailed description, taken in connection with the accompanying drawings of a preferred embodiment.

DESCRIPTION OF THE PREFERRED EMBODIMENT

Figure 1:
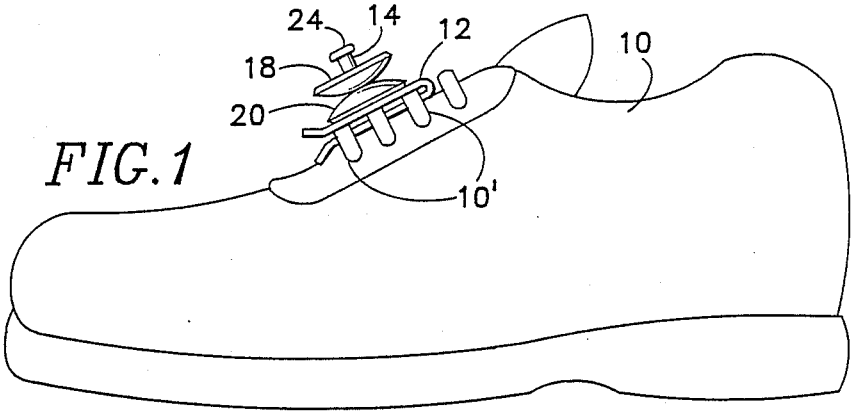
FIG. 1 is a side elevation of a conventional shoe with the cadence caller of this invention removably attached to the shoe laces by a mounting clip.
Figure 2:
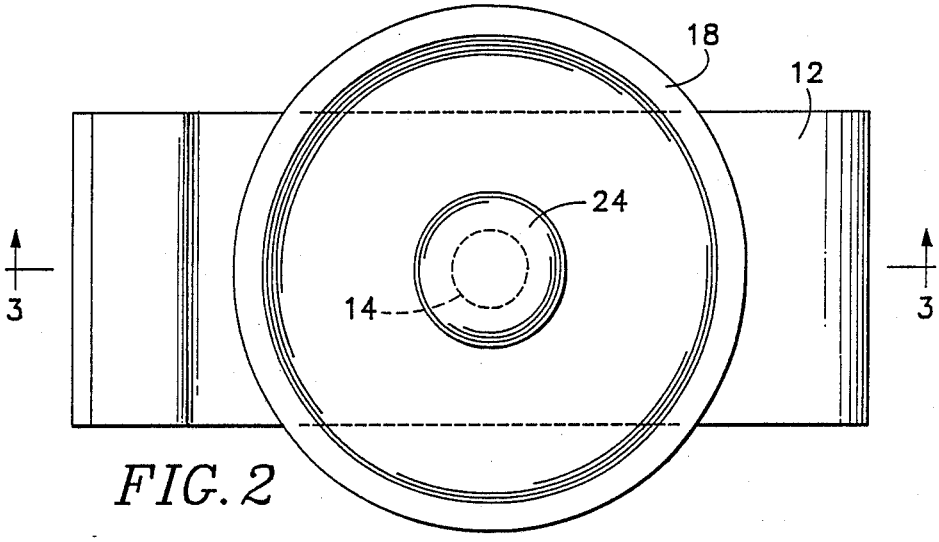
FIG. 2 is a plan view on an enlarged scale of a cadence caller embodying the features of this invention.

The present invention provides a simplified construction for a cadence caller that is worn primarily on shoes. FIG. 1 illustrates a preferred construction that is easily and quickly attachable to and removable from a shoe 10 when desired.

Figure 3:
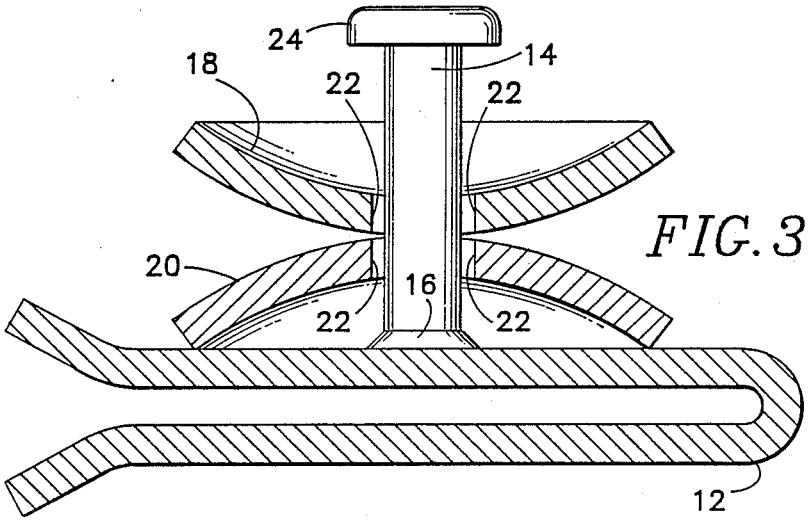
FIG. 3 is a sectional view of the cadence caller of FIG. 2 taken along the line 3—3 in FIG. 2.

In this embodiment, a U-shaped spring clip 12 is configured to frictionally capture a shoelace 10', a strap, the tongue of a shoe or any other convenient part of the shoe, pant legs, shirt, etc. between the confronting walls of the clip, as shown in FIG. 1. The clip mounts on one of its outside wall surfaces an elongated post 14 secured, as by weld 16, so as to extend upwardly from the clip, as seen best in FIG. 3.

Sound-producing means is provided in the embodiment illustrated by a pair of cymbal members 18, 20 formed of any suitable material, such as metal, to give a desired sound when they strike together. Variations in the tone or pitch of the cymbals may be easily accomplished by varying the size of the cymbals, their composition, or by other conventional methods as may be deemed appropriate. In the embodiment illustrated, an enlarged bore 22 is provided centrally through each cymbal, the bore being of greater diameter than the thickness of the post, so that when the cymbals are installed on the post they are retained freely and thus are free to move along the posts.

Alternatively, one of the cymbals 18 or 20 may be fixed in position on the post while the other cymbal is free to move thereon into and out of striking contact with the fixed cymbal if so desired. In the same manner, one cymbal member may be provided for free sliding movement along the post, the cymbal member thus being able to come into striking contact with the base clip 12.

The upper terminal end 14' of the post 14 is closed by an enlarged end cap 24 which has a greater diameter than is the bore 22 through the cymbals. Accordingly, the cymbals are thus securely captured on the peg and thus prevented from inadvertent loss from the post during their sliding movement. The cap 24 may be fixed on the post, as by welding or bonding, or alternatively may be releasably attached, as by screw threads if desired. In the latter case, the cap may be removed in order to easily replace the cymbals if it is desired to change their pitch or sound, or substitute new ones for worn ones. The end cap may also, if desired, be configured as a cymbal member fixedly mounted on the top of the post, whereby the other cymbal of the pair being provided full sliding movement along the post may come into contact with the fixed cymbal and the base clip for producing sound.

As is apparent, the cadence caller thus described may be easily attached to the shoelaces or shoe straps of a shoe, the tongue of a shoe, the lip around the upper portion of a shoe encircling the ankle, or even a sock, a pant leg, a shirt sleeve or any other such clothing article by simply slipping the clip onto the material so that it is firmly captured between the confronting legs of the U-shaped spring clip. Even when the caller is supported in a position in which the post is not extending substantially vertically as shown, the movement of the cadence caller still results in the cymbals' movement into contact with each other or their striking surface and thus still provides the desired sound. Accordingly, this cadence caller construction is particularly versatile in its ability to operate effectively in a variety of mounting orientations.

In operation, with the cadence caller of this invention attached to a shoe or the like, as described, as the caller is moved in response to a step as in walking or jogging, the cymbals are thrown about in their loose mount on the post 14. As they strike each other, or as a cymbal member contacts a striking surface, they sound, and that sound marks a step. In this manner, the jogger is given an audible indication of each step and thus may gauge the regularity of his pace by the beat of the cadence caller as well as his own learned instincts. This invention also finds utility in its use with toddlers, for a parent can keep tabs on a young child more easily by the sound produced, and be more aware of the child's activities by hearing the rate at which the caller is sounding, thus giving a good indication as to whether the child is moving or not, walking or indeed running around outside of the parent's immediate view.

From the foregoing it will be apparent to those skilled in the art that various changes, other than those already described, may be made in the size, shape, type, number and arrangement of parts described hereinbefore without departing from the spirit of this invention and the scope of the appended claims.

Having thus described my invention and the manner in which it may be used, I claim:

1. A cadence collar comprising:

(a) a base member configured as a clip arranged for releasable attachment to a conventional shoelace, (b) an elongated post member mounted at one of its ends on the upper side of said base member for vertical extension therefrom, (c) sound producing means comprising a pair of cymbal members, at least one of which is freely mounted on the post member for free sliding movement therealong, so that movement of the post-mounting base member causes the one cymbal member to move relative to and strikes the other, whereby a sound is produced, and (d) cap means on the end of the post member opposite said one end, the cap member configured to retain the cymbal members against inadvertent separation from the post member.

2. The cadence caller of claim 1 wherein said pair of cymbal members are both mounted on the post member for free sliding movement therealong, so that movement of the post-mounting base member causes the cymbal members to each move and strike against each other to make a sound.

3. The cadence caller of claim 2 wherein said pair of cymbal members are configured with a centrally located bore therethrough, the bore being greater in diameter than the thickness of the post member, so that the cymbal members are freely captured on the elongated post for free sliding movement of the cymbals therealong, and said cap means on the post member to retain the cymbal members comprises an enlarged end cap on the terminal end of the post, the end cap having a greater diameter than the bore provided through the cymbal members.

4. The Cadence Caller of claim 1 wherein said clip is configured as a U-shaped clip having two legs defining two planar side surfaces, said post member is fixedly mounted on one side surface of the U-shaped clip for extension therefrom, said pair of cymbal members each includes a centrally located, enlarged bore freely receiving the post member therethrough for free sliding movement of the cymbal members on the post member, and said end cap having a greater diameter than the diameter of the bores through the cymbal members to retain the latter on the post during movement of the cymbal members.

* * * * *